US008372266B2

(12) United States Patent
Biswas et al.

(10) Patent No.: US 8,372,266 B2
(45) **Date of Patent: *Feb. 12, 2013**

(54) SYSTEMS AND METHODS FOR PRODUCING A CRUDE PRODUCT

(75) Inventors: Goutam Biswas, Danville, CA (US); Darush Farshid, Larkspur, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 715 days.

This patent is subject to a terminal disclaimer.

(21) Appl. No.: 12/233,171

(22) Filed: Sep. 18, 2008

(65) Prior Publication Data

US 2009/0008290 A1 Jan. 8, 2009

Related U.S. Application Data

(63) Continuation-in-part of application No. 11/303,427, filed on Dec. 16, 2005, now Pat. No. 7,431,822, and a continuation-in-part of application No. 11/305,377, filed on Dec. 16, 2005, now Pat. No. 7,431,823, and a continuation-in-part of application No. 11/305,378, filed on Dec. 16, 2005, now Pat. No. 7,431,831, and a continuation-in-part of application No. 11/410,826, filed on Apr. 24, 2006, now Pat. No. 7,708,877.

(51) Int. Cl.
*C10G 67/04* (2006.01)
*C10G 65/10* (2006.01)

(52) U.S. Cl. ..... 208/59; 208/86; 208/96; 208/100; 502/167; 502/168; 502/200; 502/219; 502/221; 502/222

(58) Field of Classification Search ..... 208/57, 208/59, 85, 86, 89, 309, 412, 413, 415, 416, 208/418, 423, 96, 100; 201/25, 28; 502/150, 502/167, 168, 200, 216, 219, 221, 222
See application file for complete search history.

(56) References Cited

U.S. PATENT DOCUMENTS

| | | | | |
|---|---|---|---|---|
| 3,817,856 | A | | 6/1974 | Aaron et al. |
| 4,176,048 | A | * | 11/1979 | Corns et al. ..... 208/59 |
| 4,485,004 | A | | 11/1984 | Fisher et al. |
| 4,591,426 | A | | 5/1986 | Krasuk et al. |
| 4,592,827 | A | | 6/1986 | Galiasso et al. |
| 4,612,109 | A | | 9/1986 | Dillon et al. |
| 4,684,456 | A | | 8/1987 | Van Driesen et al. |
| 4,710,486 | A | | 12/1987 | Lopez et al. |
| 4,824,821 | A | | 4/1989 | Lopez et al. |
| 4,943,547 | A | | 7/1990 | Seamans et al. |
| 4,970,190 | A | | 11/1990 | Lopez et al. |
| 5,039,392 | A | | 8/1991 | Bearden et al. |
| 5,041,404 | A | | 8/1991 | Seamans et al. |
| 5,162,282 | A | | 11/1992 | Lopez et al. |
| 5,164,075 | A | | 11/1992 | Lopez et al. |
| 5,178,749 | A | | 1/1993 | Lopez et al. |
| 5,298,152 | A | | 3/1994 | Kramer et al. |
| 5,371,308 | A | | 12/1994 | Gosselink et al. |
| 5,374,348 | A | | 12/1994 | Sears et al. |

(Continued)

OTHER PUBLICATIONS

Pending U.S. Appl. No. 12/506,840, filed Jul. 21, 2009.

(Continued)

*Primary Examiner* — Walter D Griffin
*Assistant Examiner* — Renee E Robinson

(57) ABSTRACT

Systems and methods for hydroprocessing a heavy oil feedstock, the system employs a plurality of contacting zones and separation zones and an interstage solvent deasphalting unit. The contacting zones operate under hydrocracking conditions, employing a slurry catalyst for upgrading the heavy oil feedstock, forming upgraded products of lower boiling hydrocarbons. In the separation zones which operates at a temperature within 20° F. and a pressure within 10 psi of the pressure in the contacting zones, upgraded products are removed overhead and optionally, further treated in an in-line hydrotreater. At least a portion of the non-volatile fractions recovered from at least one of the separation zones is sent to the interstage solvent deasphalting unit, for separating unconverted heavy oil feedstock into deasphalted oil and asphaltenes. The deasphalted oil stream is sent to one of the contacting zones for further upgrade.

37 Claims, 3 Drawing Sheets

U.S. PATENT DOCUMENTS 5,484,755 A 1/1996 Lopez et al.
5,527,473 A 6/1996 Ackerman
5,871,638 A 2/1999 Pradhan et al.
5,914,010 A 6/1999 Hood et al.
5,925,238 A 7/1999 Duddy et al.
5,935,418 A 8/1999 Chakrabarty et al.
5,954,945 A 9/1999 Cayton et al.
5,977,192 A 11/1999 Howsmon et al.
6,071,402 A 6/2000 Danot et al.
6,139,723 A 10/2000 Pelrine et al.
6,156,693 A 12/2000 Song et al.
6,156,695 A 12/2000 Soled et al.
6,162,350 A 12/2000 Soled et al.
6,190,542 B1 2/2001 Comolli et al.
6,241,874 B1 6/2001 Wallace et al.
6,270,654 B1 8/2001 Colyar et al.
6,274,530 B1 8/2001 Cayton et al.
6,277,895 B1 8/2001 Zhou et al.
6,278,034 B1 8/2001 Espinoza et al.
6,291,391 B1 9/2001 MacArthur et al.
6,299,760 B1 10/2001 Soled et al.
6,451,729 B1 9/2002 Song et al.
6,534,437 B2 3/2003 Eijsbouts et al.
6,554,994 B1 4/2003 Reynolds et al.
6,620,313 B1 9/2003 Demmin et al.
6,630,066 B2 10/2003 Cash et al.
6,635,599 B1 10/2003 Eijsbouts et al.
6,652,738 B2 11/2003 Eijsbouts et al.
6,660,157 B2 12/2003 Que et al.
6,712,955 B1 3/2004 Hou et al.
6,726,832 B1 4/2004 Baldassari et al.
6,758,963 B1 7/2004 Hantzer et al.
7,150,823 B2 12/2006 Mayer et al.
7,179,366 B2 2/2007 Harle et al.
7,214,308 B2 5/2007 Colyar
7,223,713 B2 5/2007 Alonso et al.
7,232,515 B1 6/2007 Demmin et al.
7,297,250 B2 11/2007 Bronicki
7,358,413 B2 4/2008 Stell et al.
7,413,669 B2 8/2008 Gonzalez et al.
7,416,653 B2 8/2008 Wellington et al.
2002/0010088 A1 1/2002 Eijsbouts et al.
2002/0125172 A1 9/2002 Que et al.
2002/0166797 A1 11/2002 Banerjee
2003/0089636 A1 5/2003 Marchionna et al.
2003/0102254 A1 6/2003 Eijsbouts et al.
2003/0150778 A1 8/2003 Haluska et al.
2004/0134837 A1 7/2004 Dassori et al.
2004/0163999 A1 8/2004 Plantega et al.
2004/0226860 A1 11/2004 Bourges et al.
2005/0040080 A1 2/2005 Riley et al.
2005/0145538 A1 7/2005 Wellington et al.
2005/0145543 A1 7/2005 Bhan et al.
2005/0150818 A1 7/2005 Bhan et al.
2005/0155908 A1 7/2005 Bhan et al.
2005/0167320 A1 8/2005 Bhan et al.
2005/0167321 A1 8/2005 Wellington et al.
2005/0167322 A1 8/2005 Wellington et al.
2005/0167323 A1 8/2005 Wellington et al.
2005/0167324 A1 8/2005 Bhan et al.
2005/0167326 A1 8/2005 Bhan et al.
2005/0167327 A1 8/2005 Bhan et al.
2005/0167328 A1 8/2005 Bhan et al.
2005/0167329 A1 8/2005 Bhan et al.
2005/0167330 A1 8/2005 Bhan et al.
2005/0167331 A1 8/2005 Bhan et al.
2005/0167332 A1 8/2005 Bhan et al.
2005/0173298 A1 8/2005 Wellington et al.
2005/0173301 A1 8/2005 Bhan et al.
2005/0173302 A1 8/2005 Bhan et al.
2005/0173303 A1 8/2005 Bhan et al.
2005/0241992 A1 11/2005 Lott et al.
2005/0241993 A1 11/2005 Lott et al.
2006/0011511 A1 1/2006 Hokari et al.
2006/0054535 A1 3/2006 Chen et al.
2006/0060501 A1 3/2006 Gauthier et al.
2006/0060502 A1 3/2006 Soled et al.
2006/0060503 A1 3/2006 Soled et al.
2006/0157385 A1 7/2006 Montanari et al.
2006/0163115 A1 7/2006 Montanari et al.
2006/0175229 A1 8/2006 Montanari et al.
2006/0186021 A1 8/2006 Marchionna et al.
2006/0201854 A1 9/2006 Lott
2006/0207917 A1 9/2006 Domokos et al.
2006/0231465 A1 10/2006 Bhan et al.
2006/0272982 A1 12/2006 Montanari et al.
2006/0289340 A1 12/2006 Brownscombe et al.
2007/0000808 A1 1/2007 Bhan et al.
2007/0000810 A1 1/2007 Bhan et al.
2007/0012595 A1 1/2007 Brownscombe et al.
2007/0045156 A1 3/2007 Khadzhiev et al.
2007/0084754 A1 4/2007 Soled et al.
2007/0090023 A1 4/2007 Soled et al.
2007/0090024 A1 4/2007 Soled et al.
2007/0158236 A1 7/2007 Zhou et al.
2007/0158238 A1 7/2007 Wu et al.
2007/0161505 A1 7/2007 Pereira-Almao et al.
2007/0238607 A1 10/2007 Alonso et al.
2007/0284285 A1 12/2007 Stepanik et al.
2007/0295641 A1 12/2007 Brownscombe et al.
2007/0295645 A1 12/2007 Brownscombe et al.
2007/0295646 A1 12/2007 Bhan et al.
2007/0295647 A1 12/2007 Brownscombe et al.
2008/0083650 A1 4/2008 Bhan et al.
2008/0083652 A1 4/2008 Morel et al.
2008/0083655 A1 4/2008 Bhan et al.
2008/0085225 A1 4/2008 Bhan et al.
2008/0087575 A1 4/2008 Bhan et al.
2008/0087578 A1 4/2008 Bhan et al.
2008/0099371 A1 5/2008 McCoy et al.

OTHER PUBLICATIONS

Pending U.S. Appl. No. 12/506,885, filed Jul. 21, 2009.
Pending U.S. Appl. No. 12/506,987, filed Jul. 21, 2009.
Pending U.S. Appl. No. 12/506,937, filed Jul. 21, 2009.
Pending U.S. Appl. No. 12/212,737, filed Sep. 18, 2008.
Pending U.S. Appl. No. 12/233,171, filed Jul. 21, 2009.
Pending U.S. Appl. No. 12/233,393, filed Jul. 21, 2009.
Pending U.S. Appl. No. 12/233,439, filed Jul. 21, 2009.
Pending U.S. Appl. No. 12/212,796, filed Sep. 18, 2008.
Pending U.S. Appl. No. 12/233,327, filed Sep. 18, 2008.
Solvent Deasphalting of Vacuum Residue in a Bench-Scale Unit, Petroleum & Coal 48(3), 14-19, Nov. 2006. Sattarin et al.
Hydrodesulfurization Catalysis by Transition Metal Sulfides by Pecoraro et al., Journal of Catalysis 67, 430-445 (1981).
A review of zinc dialkyldithiophosphates (ZDDPS): characterization and role in the lubricating oil by Barnes et al., Tribology International 34 (2001) 389-395.
Petroleum residue upgrading with dispersed catalysts Part I. Catalysts activity and selectivity. Applied Catalysis A: General 204 (2000) 203-213.
Iron sulfide Catalysts for Coal Liquefaction Prepared Using a Micellar Technique by Chadha et al., Ind. Eng. Chem. Res. 1996, 35, 2916-2919.
Nickel, Cadium and Lead Sulfides as Catalysts in the Vapor Phase Reduction of Nitrobenzene by Brown et al., Laboratory of Physical Chemistry Indiana University, Jul. 29, 1938.
Solution Synthesis of the unsupported Ni-W sulfide hytrotreating catalysts by Le et al., Catalysis Today 130 (2008) 24-31.
Thermal decomposition of sulfur comppunds. I. 2-Methyl-2-propanethiol by Thompson et al., Bureau of Mines, Petroleum and Oil-Shale Experiment Station, Nov. 19, 1951.
Hydroprocessing of heavy petroleum feeds: tutorial by Ancheyta et al. Catalysis today 109 (2005) 3-15.
A review of recent advances on process technologies for upgrading of heavy oils and residue by Rana et al., Fuel 86 (2007) 1216-1231.
PCT International Search Report and Written Opinion, International Application No. PCT/US2009/056932, Mar. 31, 2011.
PCT International Search Report and Written Opinion, International Application No. PCT/US2009/056915, Mar. 31, 2011.

* cited by examiner

SYSTEMS AND METHODS FOR PRODUCING A CRUDE PRODUCT

CROSS-REFERENCE TO RELATED APPLICATIONS

This application is a continuation-in-part of U.S. patent application Ser. Nos. 11/303,427; 11/305,377; 11/305,378, all having a filing date of Dec. 16, 2005; and U.S. patent application Ser. No. 11/410,826, having a filing date of Apr. 24, 2006. This application claims priority to and benefits from all of the foregoing, the disclosures of which are incorporated herein by reference.

TECHNICAL FIELD

The invention relates to systems and methods for treating or upgrading heavy oil feeds, and crude products produced using such systems and methods.

BACKGROUND

The petroleum industry is increasingly turning to heavy oil feeds such as heavy crudes, resids, coals, tar sands, etc. as sources for feedstocks. These feedstocks are characterized by high concentrations of asphaltene rich residues, and low API gravities, with some being as low as less than 0° API.

PCT Patent Publication No. WO2008/014947, US Patent Publication No. 2008/0083650, US Patent Publication No. 2005/0241993, US Patent Publication No. 2007/0138057, and U.S. Pat. No. 6,660,157 describe processes, systems, and catalysts for processing heavy oil feeds. In embodiments of the prior art, the slurry catalyst concentration significantly increases in the last reacting zone, creating abnormal distributions of the flow within the reactor, solids deposition and unstable reactor operation. In high conversion slurry hydroprocessing units (with a conversion rate of >90%), if the solids content in the system is not properly controlled, the reactor can ultimately dry up and deposit solids reducing the effective reactor volume.

There is still a need for improved systems and methods to upgrade/treat process heavy oil feeds.

SUMMARY OF THE INVENTION

In one aspect, this invention relates to a process for by which a heavy oil feedstock can be upgraded. The process employs a plurality of contacting zones, separation zones and at least an interstage solvent deasphalting unit (SDA). The process comprises: a) combining a hydrogen containing gas feed, a heavy oil feedstock, and a slurry catalyst in a first contacting zone under hydrocracking conditions to convert at least a portion of the heavy oil feedstock to upgraded products; c) sending a mixture of the upgraded products, the slurry catalyst, the hydrogen containing gas, and unconverted heavy oil feedstock to a separation zone; d) in the separation zone, removing the upgraded products with the hydrogen containing gas as an overhead stream, and removing the slurry catalyst and the unconverted heavy oil feedstock as a non-volatile stream; e) sending at least a portion of the non-volatile stream to the SDA unit to separate the asphaltenes and slurry catalyst from the deasphalted oil; f) sending the deasphalted oil and the rest of the non-volatile stream from the previous separation zone to another contacting zone, under hydrocracking conditions with additional hydrogen gas and additional slurry catalyst, to convert the deasphalted oil to upgraded products; f) sending the upgraded products, the slurry catalyst, hydrogen, and unconverted deasphalted oil to a separation zone, whereby the upgraded products are removed with hydrogen as an overhead stream and the slurry catalyst and the unconverted deasphalted oil are removed as a non-volatile stream; and g) recycling to at least one of the contacting zones at least a portion of the non-volatile stream containing the slurry catalyst and the unconverted deasphalted oil.

In another aspect, there is provided a process employing a plurality of contacting zones, separation zones and at least an interstage solvent deasphalting unit (SDA) in which a heavy oil feedstock can be upgraded, and wherein at least a portion of the non-volatile stream from at least a contacting zone is sent to the SDA unit to separate the asphaltenes from the deasphalted oil.

DETAILED DESCRIPTION

Figure 1:
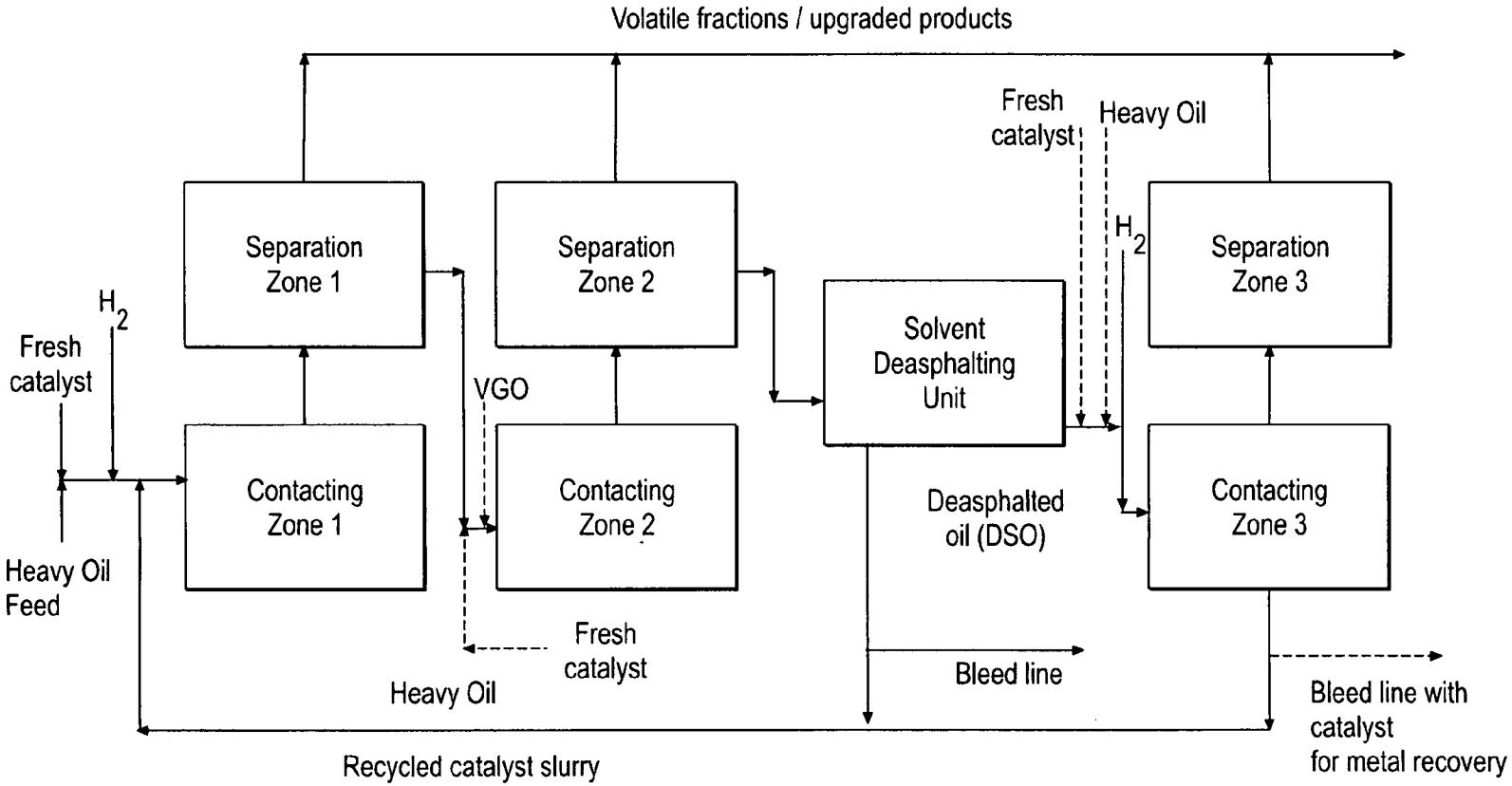
FIG. 1 is a block diagram that schematically illustrates an embodiment of a hydroprocessing system for upgrading a heavy oil feedstock, having an interstage solvent deasphalting unit in series with a plurality of contacting zones and separation zones.

The present invention relates to a system to treat or upgrade heavy oil feeds which employs an interstage solvent deasphalting (SDA) unit, for reduced coking, improved process flow and temperature distribution in the contacting zone(s).

The following terms will be used throughout the specification and will have the following meanings unless otherwise indicated.

As used herein, "heavy oil" feed or feedstock refers to heavy and ultra-heavy crudes, including but not limited to resids, coals, bitumen, tar sands, etc. Heavy oil feedstock may be liquid, semi-solid, and/or solid. Examples of heavy oil feedstock that might be upgraded as described herein include but are not limited to Canada Tar sands, vacuum resid from Brazilian Santos and Campos basins, Egyptian Gulf of Suez, Chad, Venezuelan Zulia, Malaysia, and Indonesia Sumatra. Other examples of heavy oil feedstock include bottom of the barrel and residuum left over from refinery processes, including "bottom of the barrel" and "residuum" (or "resid")—atmospheric tower bottoms, which have a boiling point of at least 343° C. (650° F.), or vacuum tower bottoms, which have a boiling point of at least 524° C. (975° F.), or "resid pitch" and "vacuum residue"—which have a boiling point of 524° C. (975° F.) or greater.

Properties of heavy oil feedstock may include, but are not limited to: TAN of at least 0.1, at least 0.3, or at least 1; viscosity of at least 10 cSt; API gravity at most 15 in one embodiment, and at most 10 in another embodiment. A gram of heavy oil feedstock typically contains at least 0.0001 grams of Ni/V/Fe; at least 0.005 grams of heteroatoms; at least 0.01 grams of residue; at least 0.04 grams C5 asphaltenes; at least 0.002 grams of MCR; per gram of crude; at least 0.0000 1 grams of alkali metal salts of one or more organic acids; and at least 0.005 grams of sulfur. In one embodiment, the heavy oil feedstock has a sulfur content of at least 5 wt. % and an API gravity of from −5 to +5. A heavy oil feed comprises Athabasca bitumen (Canada) typically has at least 50% by volume vacuum reside. A Boscan (Venezuala) heavy oil feed may contain at least 64% by volume vacuum residue.

The terms "treatment," "treated," "upgrade", "upgrading" and "upgraded", when used in conjunction with a heavy oil feedstock, describes a heavy oil feedstock that is being or has been subjected to hydroprocessing, or a resulting material or crude product, having a reduction in the molecular weight of the heavy oil feedstock, a reduction in the boiling point range of the heavy oil feedstock, a reduction in the concentration of asphaltenes, a reduction in the concentration of hydrocarbon free radicals, and/or a reduction in the quantity of impurities, such as sulfur, nitrogen, oxygen, halides, and metals.

The upgrade or treatment of heavy oil feeds is generally referred herein as "hydroprocessing." Hydroprocessing is meant any process that is carried out in the presence of hydrogen, including, but not limited to, hydroconversion, hydrocracking, hydrogenation, hydrotreating, hydrodesulfurization, hydrodenitrogenation, hydrodemetallation, hydrodearomatization, hydroisomerization, hydrodewaxing and hydrocracking including selective hydrocracking. The products of hydroprocessing may show improved viscosities, viscosity indices, saturates content, low temperature properties, volatilities and depolarization, etc.

As used herein, hydrogen refers to hydrogen, and/or a compound or compounds that when in the presence of a heavy oil feed and a catalyst react to provide hydrogen.

SCF/BBL (or scf/bbl) refers to a unit of standard cubic foot of gas ($N_2$, $H_2$, etc.) per barrel of hydrocarbon feed.

$Nm^3/m^3$ refers to normal cubic meters of gas per cubic meter of heavy oil feed.

VGO or vacuum gas oil, referring to hydrocarbons with a boiling range distribution between 343° C. (650° F.) and 538° C. (1000° F.) at 0.101 MPa.

As used herein, the term "catalyst precursor" refers to a compound containing one or more catalytically active metals, from which compound a catalyst is eventually formed. It should be noted that a catalyst precursor may be catalytically active as a hydroprocessing catalyst. As used herein, "catalyst precursor" may be referred herein as "catalyst" when used in the context of a catalyst feed.

As used herein, the term "used catalyst" refers to a catalyst that has been used in at least a reactor in a hydroprocessing operation and whose activity has thereby been diminished. For example, if a reaction rate constant of a fresh catalyst at a specific temperature is assumed to be 100%, the reaction rate constant for a used catalyst is 95% or less in one embodiment, 80% or less in another embodiment, and 70% or less in a third embodiment. The term "used catalyst" may be used interchangeably with "recycled catalyst," "used slurry catalyst" or "recycled slurry catalyst."

As used herein, the term "fresh catalyst" refers to a catalyst or a catalyst precursor that has not been used in a reactor in a hydroprocessing operation. The term fresh catalyst herein also includes "re-generated" or "rehabilitated" catalysts, i.e., catalyst that has been used in at least a reactor in a hydroprocessing operation ("used catalyst") but its catalytic activity has been restored or at least increased to a level well above the used catalytic activity level. The term "fresh catalyst" may be used interchangeably with "fresh slurry catalyst."

As used herein, the term "slurry catalyst" (or sometimes referred to as "slurry", or "dispersed catalyst") refers to a liquid medium, e.g., oil, water, or mixtures thereof, in which catalyst and/or catalyst precursor particles (particulates or crystallites) having very small average dimensions are dispersed within. In one embodiment, the medium (or diluent) is a hydrocarbon oil diluent. In another embodiment, the liquid medium is the heavy oil feedstock itself. In yet another embodiment, the liquid medium is a hydrocarbon oil other than the heavy oil feedstock, e.g., a VGO medium or diluent.

In one embodiment, the slurry catalyst stream contains a fresh catalyst. In another embodiment, the slurry catalyst stream contains a mixture of at least a fresh catalyst and a recycled (used) catalyst. In a third embodiment, the slurry catalyst stream comprises a used catalyst. In another embodiment, the slurry catalyst contains a well-dispersed catalyst precursor composition capable of forming an active catalyst in situ within the feed heaters and/or the contacting zone. The catalyst particles can be introduced into the medium (diluent) as powder in one embodiment, a precursor in another embodiment, or after a pre-treatment step in a third embodiment. In one embodiment, the medium (or diluent) is a hydrocarbon oil diluent. In another embodiment, the liquid medium is the heavy oil feedstock itself. In yet another embodiment, the liquid medium is a hydrocarbon oil other than the heavy oil feedstock, e.g., a VGO medium or diluent.

As used herein, the "catalyst feed" includes any catalyst suitable for upgrading heavy oil feed stocks, e.g., one or more bulk catalysts and/or one or more catalysts on a support. The catalyst feed may include at least a fresh catalyst, used catalyst only, or mixtures of at least a fresh catalyst and used catalyst. In one embodiment, the catalyst feed is in the form of a slurry catalyst.

As used herein, the term "bulk catalyst" may be used interchangeably with "unsupported catalyst," meaning that the catalyst composition is NOT of the conventional catalyst form which has, i.e., having a preformed, shaped catalyst support which is then loaded with metals via impregnation or deposition catalyst. In one embodiment, the bulk catalyst is formed through precipitation. In another embodiment, the bulk catalyst has a binder incorporated into the catalyst composition. In yet another embodiment, the bulk catalyst is formed from metal compounds and without any binder. In a fourth embodiment, the bulk catalyst is a dispersing-type catalyst for use as dispersed catalyst particles in mixture of liquid (e.g., hydrocarbon oil). In one embodiment, the catalyst comprises one or more commercially known catalysts, e.g., Microcat™ from ExxonMobil Corp.

As used herein, the term "contacting zone" refers to an equipment in which the heavy oil feed is treated or upgraded by contact with a slurry catalyst feed in the presence of hydrogen. In a contacting zone, at least a property of the crude feed may be changed or upgraded. The contacting zone can be a reactor, a portion of a reactor, multiple portions of a reactor, or combinations thereof. The term "contacting zone" may be used interchangeably with "reacting zone."

In one embodiment, the upgrade process comprises a plurality of reactors for contacting zones, with the reactors being the same or different in configurations. Examples of reactors that can be used herein include stacked bed reactors, fixed bed reactors, ebullating bed reactors, continuous stirred tank reactors, fluidized bed reactors, spray reactors, liquid/liquid contactors, slurry reactors, liquid recirculation reactors, and combinations thereof. In one embodiment, the reactor is an up-flow reactor. In another embodiment, a down-flow reactor. In one embodiment, the contacting zone refers to at least a slurry-bed hydrocracking reactor in series with at least a fixed bed hydrotreating reactor. In another embodiment, at least one of the contacting zones further comprises an in-line hydrotreater, capable of removing over 70% of the sulfur, over 90% of nitrogen, and over 90% of the heteroatoms in the crude product being processed.

In one embodiment, the contacting zone comprises a plurality of reactors in series, providing a total residence time ranging from 0. 1 to 15 hours. In a second embodiment, the resident time ranges from 0.5 to 5 hrs. In a third embodiment, the total residence time in the contacting zone ranges from 0.2 to 2 hours.

As used herein, the term "separation zone" refers to an equipment in which upgraded heavy oil feed from a contacting zone is either fed directly into, or subjected to one or more intermediate processes and then fed directly into the separation zone, e.g., a flash drum or a high pressure separator, wherein gases and volatile liquids are separated from the non-volatile fraction, e.g., unconverted heavy oil feed, a small amount of heavier hydrocracked liquid products (synthetic or non-volatile upgraded products), slurry catalyst and any entrained solids (asphaltenes, coke, etc.). Depending on the conditions of the separation zone, in one embodiment, the amount of heavier hydrocracked products in the non-volatile fraction stream is less than 50 wt. % (of the total weight of the non-volatile stream). In a second embodiment, the amount of heavier hydrocracked products in the non-volatile stream from the separation zone is less than 25 wt. %. In a third embodiment, the amount of heavier hydrocracked products in the non-volatile stream from the separation zone is less than 15 wt. %. It should be noted that at least a portion of the slurry catalyst remains with the upgraded feedstock as the upgraded materials is withdrawn from the contacting zone and fed into the separation zone, and the slurry catalyst continues to be available in the separation zone and exits the separation zone with the non-volatile liquid fraction.

In one embodiment, both the contacting zone and the separation zone are combined into one equipment, e.g., a reactor having an internal separator, or a multi-stage reactor-separator. In this type of reactor-separator configuration, the vapor product exits the top of the equipment, and the non-volatile fractions exit the side or bottom of the equipment with the slurry catalyst and entrained solid fraction, if any.

As used herein, the term "bleed stream" or "bleed off stream" refers to a stream containing used (or recycled) catalyst, being "bled" or diverted from the hydroprocessing system, helping to prevent or "flush" accumulating metallic sulfides and other unwanted impurities from the upgrade system.

As used herein, the term "bleed stream" or "bleed off stream" refers to a stream containing used (or recycled) catalyst, being "bled" or diverted from the hydroprocessing system, helping to prevent or "flush" accumulated metallic sulfides and other unwanted impurities from the upgrading system.

In one embodiment, the bleed off stream comprises non-volatile materials from a separation zone in the system, typically the last separation zone, comprising unconverted materials, slurry catalyst, a small amount of entrained upgraded products, small amounts of coke, asphaltenes, etc. In another embodiment, the bleed off stream is the bottom stream from an interstage solvent deasphalting unit in the system. In embodiments wherein the bleed off stream is diverted from the bottom stream of a separation zone, the bleed stream typically ranges from 1 to 30 wt. %; 3-20 wt. %; or 5-15 wt. % of the total heavy oil feedstock to the system. In embodiments therein the bleed off stream is diverted from the bottom of a deasphalting unit, the bleed off stream ranges from 0.30 to 5 wt. %; 1-30 wt. %; or 0.5 to 10 wt. % of the heavy oil feed stock.

In one embodiment, the bleed-off stream contains between 3 to 30 wt. % slurry catalyst. In another embodiment, the slurry catalyst amount ranges from 5 to 20 wt. %. In yet another embodiment, the bleed-off stream contains an amount of slurry catalyst ranging from 1 to 15 wt. % in concentration.

In one embodiment, the upgrade system comprises at least two upflow reactors in series with at least two separators, with each separator being positioned right after each reactor and with the interstage SDA unit being positioned before at least one reactor in the system. In another embodiment, the upgrade system comprises at least two upflow reactors and at least two separators in series, with of each of the separators being positioned right after each reactor, and the interstage SDA unit being position after the $1^{st}$ separator in the series. In a fourth embodiment, the upgrade system may comprise a combination of separate reactors and separate separators in series with multi-stage reactor-separators, with the SDA being positioned as an interstage treatment system between any two reactors in series.

Process Conditions: The interstage SDA unit is employed in an upgrade process having a plurality of contacting zones, with the process condition being controlled to be more or less uniformly across the contacting zones. In another embodiment, the condition varies between the contacting zones for upgrade products with specific properties.

In one embodiment, the process conditions are maintained under hydrocracking conditions, i.e., at a minimum temperature to effect hydrocracking of a heavy oil feedstock. In one embodiment, at a temperature of 410° C. to 482° C., at a pressure ranging from 10 MPa to 25 MPa.

In one embodiment, the contacting zone process temperature ranges from about 410° C. (770° F.) to about 600° C. (1112 ° F.) in one embodiment, less than about 462° C. (900° F.) in another embodiment, more than about 425° C. (797° F.) in another embodiment. In one embodiment, the temperature difference between the inlet and outlet of a contacting zone ranges from 5 to 50° F. In a second embodiment, from 10 to 40° F.

In one embodiment, the temperature of the separation zone is maintained within ±90° F. (about ±50° C.) of the contacting zone temperature in one embodiment, within ±70° F. (about ±38.9° C.) in a second embodiment, and within ±15° F. (about ±8.3° C.) in a third embodiment, and within ±5° F. (about ±2.8° C.). In one embodiment, the temperature difference between the last separation zone and the immediately preceding contacting zone is within ±50° F. (about ±28° C.).

In one embodiment, the pressure of the separation zone is maintained within ±10 to ±50 psi of the preceding contacting zone in one embodiment, and within ±2 to ±10 psi in a second embodiment.

In one embodiment, the process pressure may range from about 10 MPa (1,450 psi) to about 25 MPa (3,625 psi), about 15 MPa (2,175 psi) to about 20 MPa (2,900 psi), less than 22 MPa (3,190 psi), or more than 14 MPa (2,030 psi).

In one embodiment, the liquid hourly space velocity (LHSV) of the heavy oil feed will generally range from about 0.025 $h^{-1}$ to about 10 $h^{-1}$, about 0.5 $h^{-1}$ to about 7.5 $h^{-1}$, about 0.1 $h.^{-1}$ to about 5 $h^{-1}$, about 0.75 $h^{-1}$ to about 1.5 $h^{-1}$, or about 0.2 $h^{-1}$ to about 10 $h^{-1}$. In some embodiments, LHSV is at least 0.5 $h^{-1}$, at least 1 $h^{-1}$, at least 1.5 $h^{-1}$, or at least 2 $h^{-1}$. In some embodiments, the LHSV ranges from 0.025 to 0.9 $h^{-1}$. In another embodiment, the LHSV ranges from 0.1 to 3 LHSV. In another embodiment, the LHSV is less than 0.5 $h^{-1}$.

In one embodiment wherein all of the non-volatile fractions stream from at least a separation zone is sent to the SDA unit for deasphalting, the solid deposit in the last contacting zone in the system decreases by at least 10% (in terms of deposit volume) after a similar run time compared to a prior art operation without deasphalting with the SDA unit. In a second embodiment, the solid deposit decreases by at least 20% compared to an operation without the use of the interstage SDA unit. In a third embodiment, the solid deposit decreases at least 30%.

Hydrogen Feed: In one embodiment, a hydrogen source is provided to the process. The hydrogen can also be added to the heavy oil feed prior to entering the preheater, or after the preheater. In one embodiment, the hydrogen feed enters the contacting zone co-currently with the heavy oil feed in the same conduit. In another embodiment, the hydrogen source may be added to the contacting zone in a direction that is counter to the flow of the crude feed. In a third embodiment, the hydrogen enters the contacting zone via a gas conduit separately from the combined heavy oil and slurry catalyst feed stream. In a fourth embodiment, the hydrogen feed is introduced directly to the combined catalyst and heavy oil feedstock prior to being introduced into the contacting zone. In yet another embodiment, the hydrogen gas and the combined heavy oil and catalyst feed are introduced at the bottom of the reactor as separate streams. In yet another embodiment, hydrogen gas can be fed to several sections of the contacting zone.

In one embodiment, the hydrogen source is provided to the process at a rate (based on ratio of the gaseous hydrogen source to the crude feed) of 0.1 $Nm^3/m^3$ to about 100,000 $Nm^3/m^3$ (0.563 to 563,380 SCF/bbl), about 0.5 $Nm^3/m^3$ to about 10,000 $Nm^3/m^3$ (2.82 to 56,338 SCF/bbl), about 1 $Nm^3/m^3$ to about 8,000 $Nm^3/m^3$ (5.63 to 45,070 SCF/bbl), about 2 $Nm^3/m^3$ to about 5,000 $Nm^3/m^3$ (1 1.27 to 28,169 SCF/bbl), about 5 $Nm^3/m^3$ to about 3,000 $Nm^3/m^3$ (28.2 to 16,901 SCF/bbl), or about 10 $Nm^3/m^3$ to about 800 $Nm^3/m^3$ (56.3 to 4,507 SCF/bbl). In one embodiment, some of the hydrogen (25-75%) is supplied to the first contacting zone, and the rest is added as supplemental hydrogen to other contacting zones in system.

In one embodiment, the upgrade system produces a volume yield of least 110% (compared to the heavy oil input) in upgraded products as added hydrogen expands the heavy oil total volume. The upgraded products, i.e., lower boiling hydrocarbons, in one embodiment include liquefied petroleum gas (LPG), gasoline, diesel, vacuum gas oil (VGO), and jet and fuel oils. In a second embodiment, the upgrade system provides a volume yield of at least 115% in the form of LPG, naphtha, jet & fuel oils, and VGO.

In one embodiment of the upgrade system, at least 98 wt % of heavy oil feed is converted to lighter products. In a second embodiment, at least 98.5% of heavy oil feed is converted to lighter products. In a third embodiment, the conversion rate is at least 99%. In a fourth embodiment, the conversion rate is at least 95%. In a fifth embodiment, the conversion rate is at least 80%. As used herein, conversion rate refers to the conversion of heavy oil feedstock to less than 1000° F. (538° C.) boiling point materials.

The hydrogen source, in some embodiments, is combined with carrier gas(es) and recirculated through the contacting zone. Examples of carrier gases include nitrogen, helium, and/or argon. The carrier gas may facilitate flow of the crude feed and/or flow of the hydrogen source in the contacting zone(s). The carrier gas may also enhance mixing in the contacting zone(s). In some embodiments, a hydrogen source (for example, hydrogen, methane or ethane) may be used as a carrier gas and recirculated through the contacting zone.

Heavy Oil Feed: The unconverted heavy oil feed here herein may comprise one or more different heavy oil feeds from different sources as a single feed stream, or as separate heavy oil feed streams. In some embodiments of the present invention, at least a portion of the heavy oil feed (to be upgraded) is "split" or diverted to at least one other contacting zones in the system (other than the first contacting zone), or to the interstage SDA unit prior to being fed into a contacting zone.

In one embodiment, "at least a portion" means at least 5% of the heavy oil feed to be upgraded. In another embodiment, at least 10%. In a third embodiment, at least 20%. In a fourth embodiment, at least 30% of the heavy oil feed is diverted to at least a contacting zone other than the first one in the system. In one embodiment, the heavy oil feedstock is preheated prior to being blended with the slurry catalyst feed stream(s). In another embodiment, the blend of heavy oil feedstock and slurry catalyst feed is preheated to create a feedstock that is sufficiently of low viscosity to allow good mixing of the catalyst into the feedstock. In one embodiment, the preheating is conducted at a temperature that is about 100° C. (180° F.) less than the hydrocracking temperature within the contacting zone. In another embodiment, the preheating is at a temperature that is about 50° C. less than the hydrocracking temperature within the contacting zone.

Catalyst Feed: In some embodiments of the present invention, at least a portion of the fresh catalyst is "split" or diverted to at least one other contacting zones in the system (other than the first contacting zone). In one embodiment, "at least a portion" means at least 10% of the fresh catalyst. In another embodiment, at least 20%. In a third embodiment, at least 40%. In a fourth embodiment, at least 60% of the fresh catalyst is diverted to at least a contacting zone other than the first one in the system. In a fifth embodiment, all of the fresh catalyst is diverted to a contacting zone or than the $1^{st}$ contacting zone. In one embodiment, at least a portion of the fresh catalyst feed is sent to the contacting zone immediately following the interstage SDA unit. In another embodiment, all of the fresh catalyst is sent to contacting zone(s) other than the $1^{st}$ one in the system, with the first contacting zone only getting SDA bottoms from the SDA unit and recycled catalyst from one or more of the processes in the system, e.g., from one of the separation zones in the system.

In one embodiment, the recycled catalyst stream from one of the processes in the system, e.g., a separation zone, the SDA unit, etc., is combined with fresh slurry catalyst as one single catalyst feed stream. The combined catalyst feed is thereafter blended with the (treated or untreated) heavy oil feedstock stream(s) for feeding into the contacting zone(s). In another embodiment, the fresh catalyst and the recycled catalyst streams are blended into the heavy oil feedstock stream(s) as separate streams.

In one embodiment, the fresh catalyst is first preconditioned before entering one of the contacting zones, or before being brought into in contact with the heavy oil feed before entering the contacting zones. In one example, the fresh catalyst enters into a preconditioning unit along with hydrogen at a rate from 500 to 7500 SCF/BBL (BBL here refers to the total volume of heavy oil feed to the system), wherein the mixture is heated to a temperature between 400° F. to 1000° F., and under a pressure of 300 to 2500 psi in one embodiment; 500-3000 psi in a second embodiment; and 600-3200 psi in a third embodiment. In another example, the catalyst is preconditioned in hydrogen at a temperature of 500 to 725 ° F. It is believed that instead of bringing a cold catalyst in contact with the heavy oil feed, the preconditioning step helps with the hydrogen adsorption into the active catalyst sites, and ultimately the conversion rate.

Catalysts Employed: In one embodiment, the catalyst is a multi-metallic catalyst comprising at least a Group VIB metal and optionally, at least a Group VIII metal (as a promoter), wherein the metals may be in elemental form or in the form of a compound of the metal.

In one embodiment, the catalyst is of the formula $(M^t)_a(X^u)_b(S^v)_d(C^w)_e(H^x)_f(O^y)_g(N^z)_h$, wherein M represents at least one group VIB metal, such as Mo, W, etc. or a combination thereof, and X functions as a promoter metal, representing at least one of: a non-noble Group VIII metal such as Ni, Co; a Group VIIIB metal such as Fe; a Group VIB metal such as Cr; a Group IVB metal such as Ti; a Group IIB metal such as Zn, and combinations thereof (X is hereinafter referred to as "Promoter Metal"). Also in the equation, t, u, v, w, x, y, z representing the total charge for each of the component (M, X, S, C, H, O and N, respectively); ta+ub+vd+we+xf+yg+zh=0. The subscripts ratio of b to a has a value of 0 to 5 (0<=b/a<=5). S represents sulfur with the value of the subscript d ranging from (a+0.5b) to (5a+2b). C represents carbon with subscript e having a value of 0 to 11(a+b). H is hydrogen with the value offranging from 0 to 7(a+b). O represents oxygen with the value of g ranging from 0 to 5(a+b); and N represents nitrogen with h having a value of 0to 0.5(a+b). In one embodiment, subscript b has a value of 0, for a single metallic component catalyst, e.g., Mo only catalyst (no promoter).

In one embodiment, the catalyst is prepared from a mono-, di, or polynuclear molybdenum oxysulfide dithiocarbamate complex. In a second embodiment, the catalyst is prepared from a molybdenum oxysulfide dithiocarbamate complex.

In one embodiment, the catalyst is a $MoS_2$ catalyst, promoted with at least a group VIII metal compound. In another embodiment, the catalyst is a bulk multimetallic catalyst, wherein said bulk multimetallic catalyst comprises of at least one Group VIII non-noble metal and at least two Group VIB metals and wherein the ratio of said at least two Group VIB metals to said at least one Group VIII non-noble metal is from about 10:1 to about 1:10.

In one embodiment, the catalyst is prepared from catalyst precursor compositions including organometallic complexes or compounds, e.g., oil soluble compounds or complexes of transition metals and organic acids. Examples of such compounds include naphthenates, pentanedionates, octoates, and acetates of Group VIB and Group VII metals such as Mo, Co, W, etc. such as molybdenum naphthanate, vanadium naphthanate, vanadium octoate, molybdenum hexacarbonyl, and vanadium hexacarbonyl.

In one embodiment, the catalyst feed comprises slurry catalyst having an average particle size of at least 1 micron in a hydrocarbon oil diluent. In another embodiment, the catalyst feed comprises slurry catalyst having an average particle size in the range of 1-20 microns. In a third embodiment, the slurry catalyst has an average particle size in the range of 2-10 microns. In one embodiment, the feed comprises a slurry catalyst having an average particle size ranging from colloidal (nanometer size) to about 1-2 microns. In another embodiment, the catalyst comprises catalyst molecules and/or extremely small particles that are colloidal in size (i.e., less than 100 nm, less than about 10 nm, less than about 5 nm, and less than about 1 nm). In yet another embodiment, the catalyst comprises single layer $MoS_2$ clusters of nanometer sizes, e.g., 5-10 nm on edge.

In one embodiment, a sufficient amount of fresh catalyst and used catalyst is fed to the contacting zone(s) for each contacting zone to have a slurry (solid) catalyst concentration ranging from 2 to 30 wt. %. In a second embodiment, the (solid) catalyst concentration in the reactor ranges from 3 to 20 wt. %. In a third embodiment, from 5 to 10 wt. %.

In one embodiment, the amount of fresh catalyst feed into the contacting zone(s) range from 50 to 15000 wppm of Mo (concentration in heavy oil feed). In a second embodiment, the concentration of the fresh catalyst feed ranges from 150 to 2000 wppm Mo. In a third embodiment, from 250 to 5000 wppm Mo. In a fourth embodiment, the concentration is less than 10,000 wppm Mo. The concentration of the fresh catalyst into each contacting zone may vary depending on the contacting zone employed in the system, as catalyst may become more concentrated as volatile fractions are removed from a non-volatile resid fraction, thus requiring adjustment of the catalyst concentration.

Interstage SDA Unit: In one embodiment of the invention, a solvent deasphalting unit is employed as an intermediate unit located after one of the intermediate separation zones (or after a multi-stage reactor-separator). SDA units are typically used in refineries to extract incremental lighter hydrocarbons from a heavy hydrocarbon stream, whereby the extracted oil is typically called deasphalted oil (DAO) containing a minimal amount of asphaltenes, while leaving a residue stream behind that is more concentrated in heavy molecules and heteroatoms, typically known as DA Bottoms, etc.

In one embodiment, the oil feed to the SDA is the non-volatile stream from at least one of the separation zone(s) in the upgrade system, which comprises unconverted heavy oil feed, slurry catalyst, some heavier hydrocracked liquid products, and any entrained solids (asphaltenes, coke, etc.). In another embodiment, the oil feed comprises a mixture of untreated heavy oil feedstock and non-volatile stream from at least one of the separation zone(s). In a third embodiment, the feed to the SDA unit consists essentially of untreated heavy oil feedstock, wherein a portion of the untreated heavy oil feed to the $1^{st}$ contacting zone is diverted and sent to the SDA unit.

In one embodiment, the lighter oil products in the non-volatile stream are first removed before entering the SDA unit. The non-volatile stream in one embodiment contains about 5 to 25 wt. % asphaltenes, 5-25 wt. % slurry catalyst, and the remainder upgraded products and unconverted heavy oil products having a boiling point of up to 1500° F. To remove the light oil products, the non-volatile stream from the separation zone(s) is first let down in pressure, e.g., through a control valve then into a vapor liquid separator such as a flash drum. In some embodiments, the non-volatile stream containing unconverted heavy oil feed, heavier hydrocracked liquid products, asphaltenes and slurry catalyst is further steam-stripped before entering the SDA unit.

In one embodiment, at least 25% of the non-volatile fractions stream from the separation zone(s) in the system is treated by the SDA unit prior to being fed to the contacting zone. In a second embodiment, at least 50% of the non-volatile fractions stream is treated by the SDA unit. In a third embodiment, the feed to the SDA unit comprises a mixture of at least 25% untreated heavy oil feed and the remainder comprising non-volatile fractions from the separation zone(s).

The SDA can be a separate unit or a unit integrated into the upgrade system, wherein a mixture of hydrocarbon solvent and heavy oil feed is heated to a desired temperature and for a time sufficient to cause dissolution of the heavy oil in the solvent. The quality of the DAO and DA Bottoms from the SDA unit can be varied by adjusting the solvent used and the desired recovery of DAO relative to the feed to the SDA. It should be note that the more DAO oil that is recovered, the poorer the overall quality of the DAO, and the poorer the overall quality of the DA bottoms or SDA Tar. With respect to the solvent selection, typically, as a lighter solvent is used for the SDA, less DAO will be produced, but the quality will be better, whereas if a heavier solvent is used, more DAO will be produced, but the quality will be lower. This is due to, among other factors, the solubility of the asphaltenes and other heavy molecules in the solvent.

In one embodiment, the residence time of the SDA ranges from ½ hr. to 5 hours. In a second embodiment, from 1 to –4 hours. In a third embodiment, from 2 to 3 hours. The SDA in one embodiment operates from about 50° F. (10° C.) to about 600° F. (315° C.) or higher. The pressure should be sufficient to maintain liquid phase conditions. In one embodiment, the SDA operates under atmospheric pressure.

In one embodiment, a sufficient amount of the hydrocarbon solvent is added to SDA to give a solvent to SDA feed (volume) ratio ranging from 2:1 to 40:1. In one embodiment, the solvent to SDA feed ratio is in the range of 3:1 to 15: 1.

Various hydrocarbon solvents may be used in the SDA, depending on the desired level of deasphalting prior to feeding the contact zone. In one embodiment, the solvent is a mixture of straight and branch chained paraffinic and aromatic solvents ranging from C4 to C10, e.g., butane, isobutane, n-pentane, iso-pentane, n-heptanes iso-octane, metaxylene, or natural gas condensate, and combinations thereof. In one embodiment, the solvent is hexane. In a second embodiment, it is iso-octane.

In one embodiment, the asphaltenes and slurry catalyst (in the SDA feed) are separated from the deasphalted oil as insolubles and recovered through a proper separation device. A suitable separation device comprises gravity or vacuum filtration. The amount of asphaltenes that are typically recovered through the SDA (and exiting in the DA Bottoms) in one embodiment ranges from 5 to 30 wt. % of the oil feed, depending on the properties of the oil feed and the operating parameters of the de-asphalting process. In one embodiment, part of the DA Bottoms containing solids including asphaltenes are sent away for use in some other applications, e.g., metal recovery/separation then being blended to fuel oil, for use in asphalt, etc. In another embodiment, part of the DA Bottoms is recycled back to one of the contacting zones in the system. Although not described here, the SDA unit besides a deasphalter, also comprises a vapor/liquid separation device (e.g., a flash drum or flash evaporator) and a steam stripper for a DAO product that is substantially free of solvent.

In one embodiment, the amount of asphaltenes in the DAO is minimal, i.e., less than 3000 wppm. In a second embodiment, less than 6000 wppm. In a third embodiment, less than 10,000 wppm. In one embodiment, the DAO stream exiting the SDA unit is recovered and pumped to the next contacting zone in the series. In another embodiment, the DAO stream (containing solvent) is first heated to separate the components into solvent and DAO phases. The DAO phases are then recovered, heated, and steam stripped before being sent to one of the contacting zone(s) in series as a feed stream by itself.

In one embodiment, the DAO is sent to at least one of the contacting zones in combination with an untreated heavy oil feed stream. In another embodiment, the DAO is sent to at least one of the contacting zones in combination with an optional interstage hydrocarbon feed stream such as VGO, naptha, MCO (medium cycle oil), solvent donor or other aromatic solvents (in the range of 2-30 weight % of the untreated heavy oil feed), and/or the non-volatile bottom stream from one of the separation zones.

In one embodiment, the feed stream containing the DAO is combined with additional fresh slurry catalyst prior to being fed to the contacting zone. In another embodiment, recycled (used) slurry catalyst feed is used instead of/or in addition to a fresh slurry catalyst feed for combining with the DAO feed.

Reduced Coking With Interstage SDA Unit: In systems for upgrading heavy oil, it has also been observed that it is generally more difficult to process the heavy oil feed to the subsequent contacting zones in the system in terms of the conversion rate, properties of the resulting crude product, and deposit build-up, particularly in equipment in the later stages of the system. In embodiments of the prior art without an interstage SDA unit, an upgrade process can operated in continuous mode for an extended period of time, e.g., a few days to a few months, until there is sufficient build-up of coke and/or deposits in the process equipment reducing the effective process volume, thus prompting a shut down.

In various embodiments of the invention, it is found that with the use of an SDA unit for removal of the asphaltenes from all of, or at least a portion of the non-volatile fractions from at least one of the separation zones, the contacting zone(s) following the SDA unit operate at much lower slurry concentration compared to the prior art operations. As the direct result, a reduction in the solid deposit in the process equipment and longer run time between shut down.

In one embodiment wherein all of the non-volatile fractions stream from at least a separation zone is sent to the SDA unit for deasphalting, the solid deposit on the last contacting zone in the system reduces by at least 10% (in terms of deposit volume) after a similar run time compared to a prior art operation without deasphalting with the SDA unit. In a second embodiment, the solid deposit reduction is at least 25%. In a third embodiment, at least 50%. In one embodiment, a process having an interstage SDA unit operates for at least 20% longer in run-time before significant build-up causing shut down as compared to a prior art process without the interstage SDA unit.

Figures Illustrating Embodiments: Reference will be made to the figures to further illustrate embodiments of the invention. FIG. 1 is a block diagram schematically illustrating a system for upgrading heavy oil feedstock having an interstage SDA unit. First, a heavy oil feedstock is introduced into the first contacting zone in the system together with a slurry catalyst feed. In the figure, the slurry catalyst feed comprises a combination of fresh catalyst and recycled catalyst slurry as separate streams. Hydrogen may be introduced together with the feed in the same conduit, or optionally, as a separate feed stream. Although not shown, additional hydrocarbon oil feed, e.g., VGO (vacuum gas oil), naphtha, MCO (medium cycle oil), solvent donor, or other aromatic solvents, etc., in an amount ranging from 2 to 30 wt. % of the heavy oil feed can be optionally added as part of the feed stream to any of the contacting zones in the system.

In the contacting zones under hydrocracking conditions, at least a portion of the heavy oil feedstock (higher boiling point hydrocarbons) is converted to lower boiling hydrocarbons, forming an upgraded product. Upgraded material is withdrawn from the 1$^{st}$ contacting zone and sent to a separation zone, e.g., a hot separator, operated at a high temperature and high pressure similar to the contacting zone. The upgraded material may be alternatively introduced into one or more additional hydroprocessing reactors (not shown) for further upgrading prior to going to the hot separator. The separation zone causes or allows the separation of gas and volatile upgraded products from the non-volatile fractions. The gaseous and volatile upgraded products are withdrawn from the top of the separation zone for further processing. The non-volatile (or less volatile) fraction is withdrawn from the bottom and fed to the next contacting zone in the series. The non-volatile stream comprises slurry catalyst, heavier hydrocracked liquid products, solids, coke, and hydrocarbons newly generated in the hot separator. In one embodiment (not shown), a portion of the non-volatile stream is recycled back to one of the contacting zones preceding the separation zone, in an amount equivalent to 2 to 10% of the total heavy oil feedstock to the system, providing recycled catalyst for use in the hydroconversion reactions.

In one embodiment (as indicated by dotted lines), portions of the fresh catalyst feed and heavy oil feedstock are fed directly into contacting zones (reactors) other than the 1st contacting zone in the system.

The liquid stream from the preceding separation zone is combined with optional fresh catalyst, optional additional heavy oil feed, optional hydrocarbon oil feedstock such as VGO (vacuum gas oil), and optionally recycled catalyst (not shown) as the feed stream for the next contacting zone in the series. Hydrogen may be introduced together with the feed in the same conduit, or optionally, as a separate feed stream. Upgraded materials along with slurry catalyst flow to the next separation zone in series for separation of gas and volatile liquids from the non-volatile fractions. The gaseous and volatile liquid fractions are withdrawn from the top of the separation zone, and combined with the gaseous and volatile liquid fractions from a preceding separation zone for further processing. The non-volatile (or less volatile) fraction is withdrawn and sent to the SDA zone. The SDA zone comprises a flash drum (not shown), a steam stripper (not shown), SDA column, and pump (not shown). From the SDA zone, the deasphalted oil (DAO) is sent to the next contacting zone in the series. A portion of the SDA Bottoms is bled-off for further processing. The rest of the SDA Bottoms is recycled back to one of the contacting zones preceding the SDA unit, providing some of recycled catalyst for use in the hydroconversion reactions.

In one embodiment, the recycled stream is sent to the first contacting zone. In a second embodiment, the recycled stream is split amongst the contacting zones preceding the SDA unit. In yet another embodiment, the recycled stream comprises: at least a portion of the SDA Bottoms containing asphaltenes and slurry catalyst; at least a portion of the non-volatile stream from one of the separation zones containing the slurry catalyst, heavier hydrocracked liquid products, and the unconverted heavy oil feedstock; and optionally at least a portion of the non-volatile stream from the separation zone following the SDA unit. In one embodiment, the recycled stream consists essentially of at least a portion of the SDA Bottoms and at least a portion of the non-volatile stream from the separation zone following the SDA unit, containing slurry catalyst, heavier hydrocracked liquid products, and unconverted deasphalted oil. In yet another embodiment, the recycled stream consists essentially of either the SDA Bottoms or the non-volatile stream from the separation zone following the SDA unit. In one embodiment, the recycled stream ranges between 3 to 15 wt. % of total heavy oil feedstock to the process.

In one embodiment, a recirculating pump circulates through the loop reactor, thus maintaining a temperature difference between the reactor feed point to the exit point ranging from 1 to 50° F., and preferably between 2-25° F.

Depending on the operating conditions, the type of catalyst fed into the contacting zone and the concentration of the slurry catalyst, in one embodiment, the outlet stream from the contacting zones comprises a ratio of 20:80 to 60:40 of upgraded products to unconverted heavy oil feed. In one embodiment, the amount of upgraded products out of the first contacting zone is in the range of 30-35% to unconverted heavy oil product of 65-70%.

Although not shown in the figures, the system may optionally comprise recirculating/recycling channels and pumps for promoting the dispersion of reactants, catalyst, and heavy oil feedstock in the contacting zones, and further help control the temperature in the system. In yet another embodiment, the system may optionally comprise an in-line hydrotreater (not shown) for treating the gaseous and volatile liquid fractions from the separation zones. The in-line hydrotreater in one embodiment employs conventional hydrotreating catalysts, is operated at a similarly high pressure (within 10 psig in one embodiment and 50 psig in a second embodiment) as the rest of the upgrade system, and capable of removing sulfur, Ni, V, and other impurities from the upgraded products.

Figure 2:
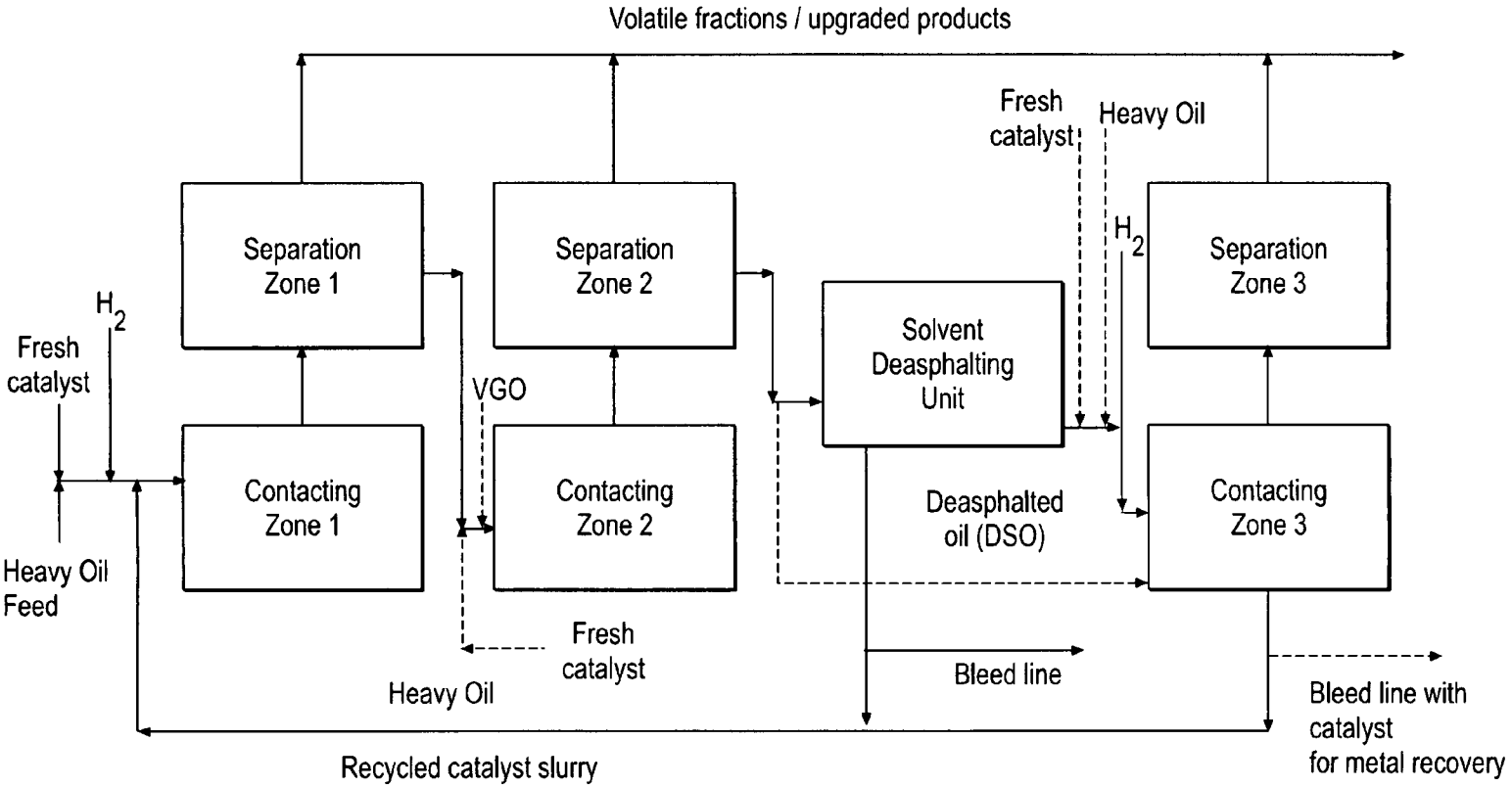
FIG. 2 is a block diagram that schematically illustrates another embodiment of a hydroprocessing system for upgrading a heavy oil feedstock with an interstage solvent deasphalting unit (SDA), wherein a portion of non-volatile (fraction from the separation zone by-passes the SDA and is sent directly to the contacting zone.

FIG. 2 is a block diagram schematically illustrating another embodiment of an upgrade system, wherein a portion of non-volatile (or less volatile) fraction from the separation zone by-passes the SDA unit and is sent directly to the contacting zone (see dotted line). In one embodiment, at least 20% of the non-volatile from the separation zone is sent directly to the contacting zone without SDA treatment. In another embodiment, at least 40%. In a third embodiment, at least 60%.

Figure 3:
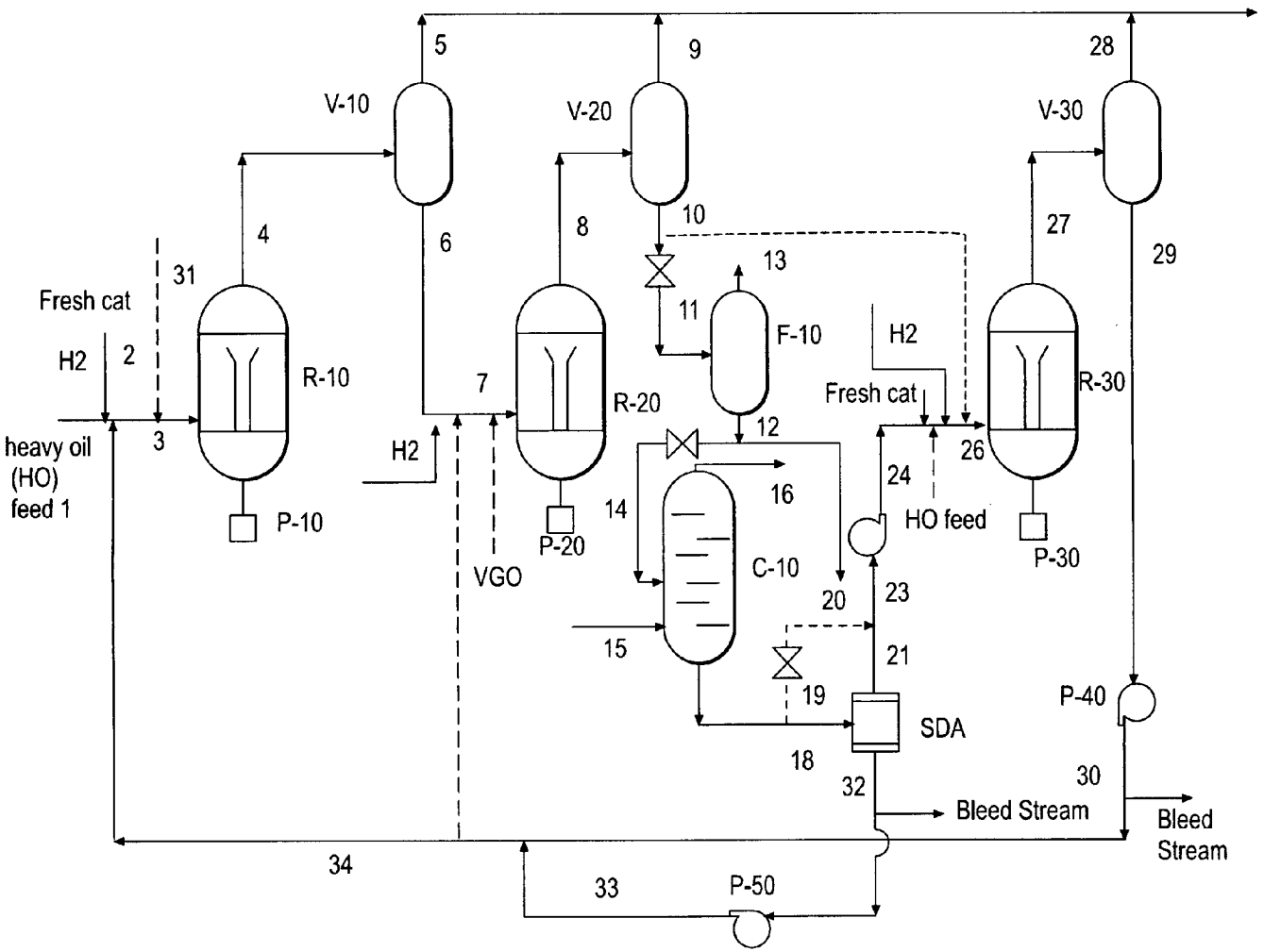
FIG. 3 is a flow diagram of a process to upgrade heavy oil feeds with an interstage solvent deasphalting unit (SDA).

FIG. 3 is a flow diagram of a heavy oil upgrade process with an interstage SDA unit for the removal of asphaltenes from at least an intermediate stream in the system. As shown, fresh catalyst feed can be split amongst the various contacting zones. Optional fresh catalyst feed 31 is combined with the recycle catalyst stream 34 and heavy oil feedstock 1 and fed to the first contacting zone as feed 3 along with hydrogen gas 2. Although not shown, heavy oil feedstock in one embodiment is preheated in furnace before being introduced into the contacting zone as heated oil feed.

Stream 4 comprising upgraded heavy oil feedstock exits the contacting zone R-10 flows to a separation zone V-10, wherein gases (including hydrogen) and upgraded products in the form of volatile liquids are separated from the non-volatile liquid fraction 6 and removed overhead as stream 5. The non-volatile fraction 6 is sent to the next contacting zone R-20 in series for further upgrade. Stream 6 contains slurry catalyst in combination with some heavier hydrocracked liquid products, unconverted oil, and small amounts of coke and asphaltenes in some embodiments.

The upgrade process continues with the other contacting zones as shown, wherein feed stream 7 to contacting zone R-20 comprises non-volatile fractions, hydrogen feed, optional VGO, and optional fresh catalyst feed. Stream 8 comprising upgraded heavy oil feedstock flows to separation zone V-20, wherein upgraded products are combined with hydrogen and removed as overhead product 9. Bottom stream 10 containing non-volatile fractions, e.g., catalyst slurry, some heavier hydrocracked liquid products, unconverted oil containing coke and asphaltenes is let down in pressure through a control valve, flashed in drum F-10, and steam-tripped in column C-10 at low pressure, e.g., less than 100 psi. In one embodiment (as shown with dotted lines), at least a portion of the non-volatile stream 10 by-passes the SDA unit and is fed directly to the next contacting zone in the series R-30. This by-pass stream can be varied depending on the quality of the heavy oil feedstock to the system, operating conditions (levels of coke deposit, etc.), desired product quality, amongst other factors.

In one embodiment as shown, a portion of the bottoms from C-10, stream 18, is taken to the SDA unit to separate deasphalted oil (DAO) 21 from the asphaltenes and slurry catalyst. In another embodiment (not shown), all of the bottoms from C-10 is sent directly to the SDA unit for asphaltene separation as stream 18. In one embodiment, the by-pass stream 20 is at least 20 wt. % of the bottoms from C-10. In another embodiment, it is at least 50%. In a third embodiment, it is less than 5 wt. %. In a fourth embodiment, the SDA by-pass stream ranges between 10 to 50 wt. % of the DAO stream.

The raffinate stream 21 containing the DAO is combined with the by-pass stream 20 and pumped to the next contacting zone in series R-30 as stream 24. Some of the DAO Bottoms stream 32 containing catalyst slurry, coke and asphaltenes is sent to other processes in the system for catalyst de-oiling, metal recovery, etc., as bleed-off stream.

In one embodiment as shown, fresh catalyst, optional hydrocarbon feed such as VGO (not shown), optional untreated heavy oil feed (not shown), and hydrogen is added to stream 24 for feeding into contacting zone R-30. Upgraded products, unconverted heavy oil, slurry catalyst, hydrogen, etc. are removed overhead as stream 27 and sent to the next separation zone V-30. Overhead stream 28 containing hydrogen and upgraded products is combined with the overhead streams from preceding separation zones, and sent away for subsequent processing in another part of the system, e.g., to a high pressure separator and/or lean oil contactor and/or an in-line hydrotreater (not shown).

The following examples are given as non-limitative illustration of aspects of the present invention.

COMPARATIVE EXAMPLE 1

Heavy oil upgrade experiments can be carried out using a pilot slurry phase hydroprocessing system similar to that shown in FIG. 3, with 3 gas-liquid slurry phase reactors connected in series and a recycling catalyst stream. Each reactor is a continuously stirred reactor type.

The slurry catalyst can be prepared according to the teaching of U.S. Pat. No. 2006/0058174, i.e., a Mo compound is first mixed with aqueous ammonia forming an aqueous Mo compound mixture, sulfided with hydrogen compound, promoted with a Ni compound, then transformed in a hydrocarbon oil (other than heavy oil feedstock) at a temperature of at least 350° F. and a pressure of at least 200 psig, forming an active slurry catalyst. The concentration of the active slurry catalyst in the heavy oil ranges from 2,000 to 5,000 ppm, expressed as weight of metal (molybdenum) to weight of heavy oil feed. The hydroprocessing conditions can be as follows: a reactor temperature of 815-825° F.; a total pressure in the range of 2400 to 2600 psig; a fresh Mo/fresh heavy oil feed ratio (wt. %) 0.20-0.40; fresh Mo catalyst /total Mo catalyst ratio 0.1; total feed LHSV 0.10 to 0.15; and $H_2$ gas rate (SCF/ bbl) of 10000 to 15000.

Effluent taken from each reactor is introduced into a hot separator, which separates the effluent into a hot vapor and gaseous stream, which is removed from the top, and a liquid/slurry product stream, which is removed from the bottom.

The feed blend to the reactor can be a blend of two different heavy oil feedstock, 97% VR1 and 3% of a VGO oil with the following properties:

| | VR1 | VGO |
|---|---|---|
| API gravity at 60/60 | 3.9 | 15.6 |
| Sulfur (wt %) | 5.58 | 3.28 |
| Nitrogen (ppm) | 5770 | 1177 |
| Nickel (ppm) | 93 | — |
| Vanadium (ppm) | 243 | — |
| Carbon (wt %) | 83.57 | 85.29 |
| Hydrogen (wt %) | 10.04 | 11.01 |
| MCRT (wt %) | 17.2 | 0.04 |

-continued

| | VR1 | VGO |
|---|---|---|
| Viscosity @ 212° F. (cSt) | 3727 | — |
| Pentane Asphaltenes (wt %) | 13.9 | — |
| Fraction Boiling above 1050° F. (wt %) | 81 | 85 |

The product yields, properties and conversion are anticipated to be as follows with middle distillates composing at least 50% of the product: C4-gas (wt %) 12.1; C5-180° F. (wt %) 7.5; hydrocarbon with boiling point (B.P.) 180-350° F. (wt %) 15.5; hydrocarbons with B.P. 350-500° F. (wt %) 20.8; hydrocarbons with B.P. 500-650° F. (wt %) 22.2; hydrocarbons with B.P. 650-800° F. (wt %) 14.8; hydrocarbons with B.P. 800-1000° F. (wt %) 3.9; hydrocarbons with B.P. 1000° F.+(wt %) 0.3; HDN conversion (%) 62; HDS conversion (%) 94; HDM conversion (%) 99; and liquid product API gravity 33.

The operation is expected to run between 60 to 100 days before shut down due to coke build up in the equipment.

EXAMPLE 2

Example 1 is duplicated with the addition of a solvent deasphalting unit. In this example, the residue comprising the liquid/slurry product stream from the $2^{nd}$ hot separator is sent to steam-stripping and deasphalting at a temperature from 80 to 180° C. Different solvents are used, including propane, n-butane and n-pentane.

The product to be deasphalted and a volume of solvent equal to 8-10 times the residue are charged into an autoclave. The residue and solvent mixture is heated to a temperature of 80-180° C. and subject to stirring by means of a mechanical stirrer for a period of 20-60 minutes. At the end of the operation, decanting is effected for the separation of the two phases, the asphaltene and slurry catalyst phase on the bottom of the autoclave, and the deasphalted oil (DAO) diluted in the solvent. The decanting may take between 30 minutes to 3 hours. The DAO solvent can be transferred by means of a suitable recovery system to a second tank. The solvent can be recovered/eliminated by evaporation, and the DAO can be heated and pumped to the last reactor in the series to continue with the hydroconversion.

It is expected that there is at least 20% less coke build up in the last reactor in the set after 60-100 days of operation as compared to the coke build up in the last reactor of Comparative Example 1.

For the purpose of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that may vary depending upon the desired properties sought to be obtained and/or the precision of an instrument for measuring the value, thus including the standard deviation of error for the device or method being employed to determine the value. The use of the term "or" in the claims is used to mean "and/or" unless explicitly indicated to refer to alternatives only or the alternative are mutually exclusive, although the disclosure supports a definition that refers to only alternatives and "and/or." The use of the word "a" or "an" when used in conjunction with the term "comprising" in the claims and/or the specification may mean "one," but it is also consistent with the meaning of "one or more," "at least one," and "one or more than one." Furthermore, all ranges disclosed herein are inclusive of the endpoints and are independently combinable. In general, unless otherwise indicated, singular elements may be in the plural and vice versa with no loss of generality. As used herein, the term "include" and its grammatical variants are intended to be non-limiting, such that recitation of items in a list is not to the exclusion of other like items that can be substituted or added to the listed items.

It is contemplated that any aspect of the invention discussed in the context of one embodiment of the invention may be implemented or applied with respect to any other embodiment of the invention. Likewise, any composition of the invention may be the result or may be used in any method or process of the invention. This written description uses examples to disclose the invention, including the best mode, and also to enable any person skilled in the art to make and use the invention. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims. All citations referred herein are expressly incorporated herein by reference.

The invention claimed is:

1. A process for hydroprocessing a heavy oil feedstock, the process employing a plurality of contacting zones and separation zones, the process comprising:

combining a heavy oil feedstock, a hydrogen containing gas, and a slurry catalyst in a hydrocarbon oil diluent which is not heavy oil feedstock, which slurry catalyst is unsupported in a first contacting zone under hydrocracking conditions to convert at least a portion of the heavy oil feedstock to lower boiling hydrocarbons, forming upgraded products;

sending a mixture of the upgraded products, the slurry catalyst, the hydrogen containing gas, and unconverted heavy oil feedstock to a separation zone, whereby volatile upgraded products are removed with the hydrogen containing gas from the separation zone as a first overhead stream, and the slurry catalyst, non-volatile upgraded products, and the unconverted heavy oil feedstock are removed from the separation zone as a first non-volatile stream;

sending at least a portion of the first non-volatile stream to a solvent deasphalting unit;

obtaining from the solvent deasphalting unit two streams, a stream comprising deasphalted oil, and a stream comprising asphaltenes and the slurry catalyst;

sending the deasphalted oil to a contacting zone other than the first contacting zone, which contacting zone is maintained under hydrocracking conditions with additional hydrogen containing gas feed and additional slurry catalyst feed to convert at least a portion of the deasphalted oil to lower boiling hydrocarbons, forming additional upgraded products;

sending a mixture of the additional upgraded products, the slurry catalyst, the additional hydrogen containing gas, and unconverted deasphalted oil to a second separation zone, wherein volatile additional upgraded products and the additional hydrogen containing gas as removed as a second overhead stream, and the slurry catalyst, non-volatile additional upgraded products and the unconverted deasphalted oil are removed as a second non-volatile stream; and recycling to at least one of the contacting zones a recycled stream comprising at least one of: a) a portion of the stream containing asphaltenes and slurry catalyst; b) a portion of the first non-volatile stream; c) a portion of the second non-volatile stream, and d) mixtures thereof;

wherein the slurry catalyst is of the formula $(M^t)_a(X^u)_b(S^v)_d(C^w)_e(H^x)_f(O^y)_g(N^z)_h$, wherein M is at least one group VIB metal; and X is at least a promoter metal selected from: a non-noble Group VIII metal; a Group VIB metal; a Group IVB metal and a Group IIB metal, and combinations thereof; t, u, v, w, x, y, z representing the total charge for each of M, X, S, C, H, O and N, respectively; ta+ub+vd+we+xf+yg+zh=0; 0<=b/a <=5; S is sulfur with d ranging from (a+0.5b) to (5a+2b); C is carbon with e having a value of 0 to 11(a+b); H is hydrogen with f ranging from 0 to 7(a+b); O is oxygen with the value of g ranging from 0 to 5(a+b); and N is nitrogen with h having a value of 0 to 0.5(a+b); and b>=0 and a>0.

2. The process of claim 1, wherein at least 25% of the first non-volatile stream is sent to the solvent deasphalting unit for separation.

3. The process of claim 2, wherein at least 50% of the first non-volatile stream is sent to the solvent deasphalting unit for separation.

4. The process of claim 2, wherein all of the first non-volatile stream is sent to the solvent deasphalting unit for separation.

5. The process of claim 1, wherein the first non-volatile stream is first let down in pressure through a control valve prior to being sent to the solvent deasphalting unit.

6. The process of claim 5 wherein the first non-volatile stream after being let down in pressure is sent to a flash drum and steam-stripped prior to being sent to the solvent deasphalting unit.

7. The process of claim 1, wherein the first non-volatile stream is processed in the solvent deasphalting unit by:

contacting the first non-volatile stream with a hydrocarbon solvent to produce a mixture comprising the hydrocarbon solvent, the slurry catalyst, and unconverted heavy oil feedstock containing asphaltenes; and separating the mixture to produce a stream containing deasphalted oil ("DAO") and a stream containing slurry catalyst and asphaltenes.

8. The process of claim 7, wherein the hydrocarbon solvent comprises at least one of butane, iso-butane, n-pentane, iso-pentane, n-heptanes iso-octane, metaxylene, natural gas condensate, and combinations thereof.

9. The process of claim 7, wherein the first non-volatile stream to hydrocarbon solvent volume ratio ranges from 2:1 to 40:1.

10. The process of claim 9, wherein the first non-volatile stream to hydrocarbon solvent volume ratio ranges from 3:1 to 15:1.

11. The process of claim 7, wherein the stream containing deasphalted oil contains less than 10,000 wppm asphaltenes.

12. The process of claim 11, wherein the stream containing deasphalted oil contains less than 6,000 wppm asphaltenes.

13. The process of claim 1, wherein the recycled stream to at least one of contacting zones consists essentially of a portion of the stream containing asphaltenes and slurry catalyst.

14. The process of claim 1, wherein the recycled stream to at least one of contacting zones comprises at least a portion of the stream containing asphaltenes and slurry catalyst, and at least a portion of the second non-volatile stream.

15. The process of claim 1, wherein the recycled stream ranges between 3 to 15 wt. % of the heavy oil feedstock.

16. The process of claim 1, wherein the recycled stream is sent to the first contacting zone.

17. The process of claim 16, wherein the recycled stream to the first contacting zone consists essentially of at least a portion of the stream containing asphaltenes and slurry catalyst.

18. The process of claim 17, wherein the recycled stream to the first contacting zone consists essentially of at least a portion of the second non-volatile stream.

19. The process of claim 1, wherein at least a portion of the stream containing asphaltenes and slurry catalyst is removed from the process as a bleed-off stream for the process to have a conversion rate of at least 98.5%.

20. The process of claim 19, wherein the bleed-off stream contains between 3 to 30 wt. % solid, as used slurry catalyst.

21. The process of claim 1, wherein at least a portion of the second non-volatile stream is removed from the process as a bleed-off stream for the process to have a conversion rate of at least 98.5%.

22. The process of claim 21, wherein the bleed-off stream contains between 5 to 20 wt. % solid, as used slurry catalyst.

23. The process of claim 1, wherein the contacting zones are maintained under hydrocracking conditions with a temperature of 410° C. to 600° C., and a pressure from 10 MPa to 25 MPa.

24. The process of claim 1, wherein the separation zones are maintained at a temperature within 90° F. of the temperature of the contacting zones, and a pressure within 50 psi of the pressure in the contacting zones.

25. The process of claim 1, wherein the slurry catalyst has an average particle size in the range of 1-20 microns.

26. The process of claim 25, wherein the slurry catalyst comprises clusters of colloidal sized particles of less than 100 nm in size, wherein the clusters have an average particle size in the range of 1-20 microns.

27. The process of claim 1, wherein the process employs a plurality of contacting zones and separation zones, and wherein at least one contacting zone and at least one separation zone are combined into one equipment as a reactor having an internal separator.

28. The process of claim 1, further comprising a plurality of recirculating pumps for promoting dispersion of the heavy oil feedstock and the slurry catalyst in the contacting zones.

29. The process of claim 1, wherein additional hydrocarbon oil feed other than heavy oil feedstock, in an amount ranging from 2 to 30 wt. % of the heavy oil feedstock, is added to any of the contacting zones.

30. The process of claim 29, wherein the additional hydrocarbon feed is selected from vacuum gas oil, naptha, medium cycle oil, solvent donor and aromatic solvents.

31. The process of claim 1, further comprising an in-line hydrotreater employing hydrotreating catalysts and operating at a pressure within 50 psig of the contacting zones, for removing at least 70% of sulfur, at least 90% of nitrogen, and at least 90% of heteroatoms in the upgraded products.

32. The process of claim 1, for treating a heavy oil feedstock having a TAN of at least 0.1; a viscosity of at least 10 cSt; an API gravity at most 15; at least 0.0001 grams of Ni/V/Fe; at least 0.005 grams of heteroatoms; at least 0.01 grams of residue; at least 0.04 grams C5 asphaltenes; and at least 0.002 grams of MCR.

33. The process of claim 1, wherein at least a portion of the heavy oil feedstock to the process is diverted to a contacting zone other than the first contacting zone, wherein the at least a portion of the diverted heavy oil feedstock, under hydrocracking conditions, is converted to lower boiling hydrocarbons.

34. The process of claim 1, wherein the slurry catalyst feed comprises a used slurry catalyst and a fresh slurry catalyst, wherein the fresh slurry catalyst is fed into a contacting zone other than the first contacting zone.

35. The process of claim 34, wherein all of the fresh slurry catalyst is for feeding into contacting zones other than the first contacting zone.

36. A process for hydroprocessing a heavy oil feedstock, the process employing a plurality of contacting zones and separation zones, the process comprising:

combining a heavy oil feedstock, a hydrogen containing gas, and an unsupported slurry catalyst in a hydrocarbon oil diluent which is not heavy oil feedstock, in a first contacting zone under hydrocracking conditions at a temperature of 410° C. to 482° C., and a pressure from 10 MPa to 25 MPa to convert at least a portion of the heavy oil feedstock to lower boiling hydrocarbons, forming upgraded products;

sending a mixture of the upgraded products, the slurry catalyst, the hydrogen containing gas, and unconverted heavy oil feedstock to a separation zone, whereby volatile upgraded products are removed with the hydrogen containing gas from the separation zone as an overhead stream, and the slurry catalyst, non-volatile upgraded products, and the unconverted heavy oil feedstock are removed from the separation zone as a first non-volatile stream, wherein the separation zone is maintained at a temperature within 20° F. of the temperature of the contacting zones, and a pressure within 10 psi of the pressure in the contacting zones and;

sending the first non-volatile stream to a solvent deasphalting unit;

obtaining from the solvent deasphalting unit two streams, a stream comprising deasphalted oil, and a stream containing asphaltenes and the slurry catalyst;

sending the deasphalted oil to a contacting zone other than the first contacting zone, which contacting zone is maintained under hydrocracking conditions with additional hydrogen containing gas feed and additional slurry catalyst feed to convert at least a portion of the deasphalted oil to lower boiling hydrocarbons, forming additional upgraded products;

sending a mixture of the additional upgraded products, the slurry catalyst, the additional hydrogen containing gas, and unconverted deasphalted oil to a separation zone other than the first separation zone, wherein the upgraded products and the additional hydrogen containing gas as removed as an overhead stream and separated from a second non-volatile stream comprising the slurry catalyst and the unconverted deasphalted oil;

recycling to at least one of the contacting zones a recycled stream comprising at least one of: a) a portion of the stream containing asphaltenes and slurry catalyst; b) a portion of the first non-volatile stream containing the slurry catalyst and the unconverted heavy oil feedstock; c) a portion of the second non-volatile stream, and d) mixtures thereof;

wherein the slurry catalyst is of the formula $(M^t)_a(X^u)_b(S^v)_d(C^w)_e(H^x)_f(O^y)_g(N^z)_h$, wherein M is at least one group VIB metal; and X is at least a promoter metal selected from: a non-noble Group VIII metal; a Group VIB metal; a Group IVB metal and a Group IIB, metal, and combinations thereof; t, u, v, w, x, y, z representing the total charge for each of M, X, S, C, H, O and N, respectively; ta+ub+vd+we+xf+yg+zh=0; 0<=b/a <=5; S is sulfur with d ranging from (a+0.5b) to (5a+2b); C is carbon with e having a value of 0 to 11(a+b); H is hydrogen with f ranging from 0 to 7(a+b); O is oxygen with the value of g ranging from 0 to 5(a +b); and N is nitrogen with h having a value of 0 to 0.5(a+b); and b>=0 and a>0.

37. The process of claim 36, wherein the slurry catalyst has an average particle size in the range of 1-20 microns.

* * * * *